United States Patent [19]

Sprengling

[11] 4,275,993

[45] Jun. 30, 1981

[54] COMPOSITE FAN BLADE ASSEMBLY

[75] Inventor: Kurt Sprengling, Jacksonville, Fla.

[73] Assignee: Stanley Industrial Corporation, Jacksonville, Fla.

[21] Appl. No.: 924,617

[22] Filed: Jul. 14, 1978

[51] Int. Cl.[3] ..... F04D 29/36

[52] U.S. Cl. ..... 416/207; 416/214 R; 416/239

[58] Field of Search ..... 416/207, 208, 214 R, 416/229, DIG. 3, 234, 239

[56] References Cited

U.S. PATENT DOCUMENTS

| | | | |
|---|---|---|---|
| 1,530,436 | 3/1925 | Strout | 416/207 |
| 2,350,345 | 6/1944 | Freedman et al. | 416/209 |
| 2,563,011 | 8/1951 | Dehnicke | 416/207 |
| 2,664,961 | 1/1954 | Goede | 416/207 |
| 2,765,859 | 10/1956 | Hartzell et al. | 416/207 |
| 3,545,885 | 12/1970 | Killam | 416/207 |
| 4,053,259 | 10/1977 | Bianchi | 416/208 |

*Primary Examiner*—Everette A. Powell, Jr.

*Attorney, Agent, or Firm*—Arthur G. Yeager

[57] ABSTRACT

A longitudinal extruded aluminum fan blade having an integral elongated shank extending from one blade end is connected to a pair of elongated mounting members having abutting surface portions in general conformance with and generally coextensive of respective top and bottom surface portions of the shank and having tapered portions overlying blade regions adjoining the shank with the blade regions being free of any connections extending therethrough to inhibit fatigue failure of the blade. The mounting members and the shank define a stem portion having one or more circumferential grooves and the stem portion is adapted to be attached in various pitch positions to a rotor having a flat surface. A coupling device includes a mounting saddle having a flat side abutting the flat rotor surface and an opposite side provided with curved ribs received in portions of the grooves. The coupling device further comprises one or more U-shaped clamps having intermediate curved portions disposed in other portions of the grooves and end portions connected to the rotor.

17 Claims, 8 Drawing Figures

COMPOSITE FAN BLADE ASSEMBLY

BACKGROUND OF THE INVENTION

1. Field of the Invention

The present invention relates to a fan assembly and more particularly to a composite blade assembly and coupling elements for adjustably securing the blade assemblies in different pitch positions.

2. Description of the Prior Art

Propellers and blades which rotate at relatively high speeds are subjected to not only centrifugal forces but also shear forces, bending moments and repeated loadings at different levels which may result in fatigue failures. In addition, the rotating propellers are subjected to stress concentrations resulting from material imperfections and/or discontinuities in the elements, such as notches or holes, which may result in a fracture or failure of the material at the imperfection or discontinuity. Accordingly, there has been a trend to develop propellers of a lightweight strong material, such as aluminum or the like, and connect the propellers to a rotor or hub assembly with adequate, efficient connections.

Propellers which include coupling elements for securing propeller blades to a rotor hub are generally disclosed in U.S. Pat. Nos. 1,816,317, 1,862,328, 1,865,170, 2,289,400, and 2,350,345. Further, U.S. Pat. No. 3,461,966 discloses another type of propeller assembly which incorporates a continuous propeller blade constructed of a lightweight material such as aluminum. Propellers which include integral mounting flanges adapted to be disposed between mounting members are generally disclosed in U.S. Pat. Nos. 1,771,365 and 2,542,251.

Fan apparatus comprising a rotor, a plurality of fan blades and coupling means for securing the fan blades to the rotor, have been manufactured and described in the literature. For example, LAU Industries Incorporated of Dayton, Ohio make LAU ring fans incorporating extruded blades that are welded to cast hubs. Further, Western Engineering and Mfg. Co. of Marina Del Rey, California has produced aluminum alloy cast blades, under the name Valkyrie propellers, provided with cylindrical grooved shanks permitting the blades to be adjustably secured to a cast or the like rotor at desired pitch position. Additionally, American Coolair Corporation of Jacksonville, Florida, has manufactured propeller fans which include extruded aluminum blades fastened to cast clamshell members which, in turn, are fastened to a cast rotor. Although extruded blades are widely used as fan blades, problems have been encountered in connecting the extruded blades to mounting members with bolts, rivets or like fasteners and adjustably connecting the mounting members and blade to a rotor.

For various blade assemblies wherein a fan blade is connected to a mounting member with bolts, rivets or similar clamping elements, it is preferable to form a friction type connection between the fan blade and mounting member to preclude performance problems such as fatigue effects resulting from stress reversals, stress fluctuations and stress discontinuities. However, with friction-type connections the frictional resistance is proportional to the clamping force of the fasteners and a yielding of the fasteners often results in a partial bearing-type connection wherein the loading effects of stress fluctuations, stress discontinuities (eg. resulting from holes or notches) and stress concentrations tend to have a more pronounced adverse effect on the behavior of the connection. Accordingly, the fan apparatus and blade assemblies built according to the present invention are designed to overcome problems, such as fatigue failure, encountered with other prior art.

SUMMARY OF THE INVENTION

This invention relates to a fan apparatus comprising a rotor assembly including a rotor having an axis of rotation and a plurality of fan blade assemblies coupled to the rotor. Each of the fan blade assemblies includes an elongated blade provided with top and bottom surfaces, inner and outer end portions and a longitudinal axis; an elongated shank having a lateral dimension less than the lateral dimension of the blade, integrally formed with the blade inner end portion, having top and bottom surfaces forming respective continuations of the blade top and bottom surfaces and having a longitudinal axis substantially parallel with the longitudinal axis of the blade; an elongated first mounting member having an abutting surface portion generally conforming to and generally coextensive with the shank top surface and an adjoining region of the top surface of the blade inner end portion; and an elongated second mounting member having an abutting surface portion generally conforming to and generally coextensive with the shank bottom surface and an adjoining region of the bottom surface of the blade inner end portion. The rotor assembly further includes coupling means attached to the rotor for adjustably clamping the shank and the adjoining regions of the blade top and bottom surfaces between the abutting surfaces of the first and second mounting members, whereby the coupling means adjustably secures the blade assemblies in different pitch positions on the rotor.

Another aspect of this invention relates to elongated mounting members having generally semi-cylindrical first end portions adapted to respectively generally contact the shank top and bottom surfaces and generally semi-conical second end portions converging from said first end portion and adapted to respectively juxtapose with the top and bottom adjoining regions of the inner portion of the blade. The first end portions of the mounting members and shank define a stem portion having one or more circumferential grooves adapted to receive rib means. More particularly, the circumferential grooves include circular grooves in the cylindrical surfaces of the first end portions of the mounting members and grooves in the side edges of the shank, extending substantially from the bottom to the top surface of the shank.

A more specific aspect of this invention relates to a fan assembly which further comprises passages extending through the mounting members and shank with assembly means extending therethrough when the passages are aligned. The assembly means comprises a deformable element so that the mounting members and shank can be moved relative to each other to align the respective groove portions of the circumferential groove.

A more specific aspect of this invention relates to a rotor having a flat surface and coupling means including a mounting saddle having a flat side mounted on the rotor flat surface and an opposite side provided with rib means in the form of a curved rib received in a portion of one circumferential groove. The coupling means further includes clamp means in the form of a U-shaped clamp having an intermediate curved portion constituting another portion of the rib means and disposed in substantially the remaining portion of the one circumferential groove and clamp end portions extending through passages in the rotor and attached with connecting means to the side of the rotor opposite the flat rotor surface.

Still another specific aspect of this invention relates to a blade and shank formed of durable material, such as extruded aluminum, and mounting members formed of a rigid material, such as cast aluminum.

Accordingly, an object of this invention is to provide an exceedingly efficient fan construction which is durable, well-balanced and wherein the blade assemblies may be readily removed, replaced and adjusted.

A particular object is the provision of a simplified clamping arrangement for securing a fan blade to a rotor assembly with a strong, reliable connection.

Another particular object is to provide a blade assembly which is simple in construction, well-balanced and easily manufactured within specific tolerances.

BRIEF DESCRIPTION OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE PREFERRED EMBODIMENTS

Figure 1:
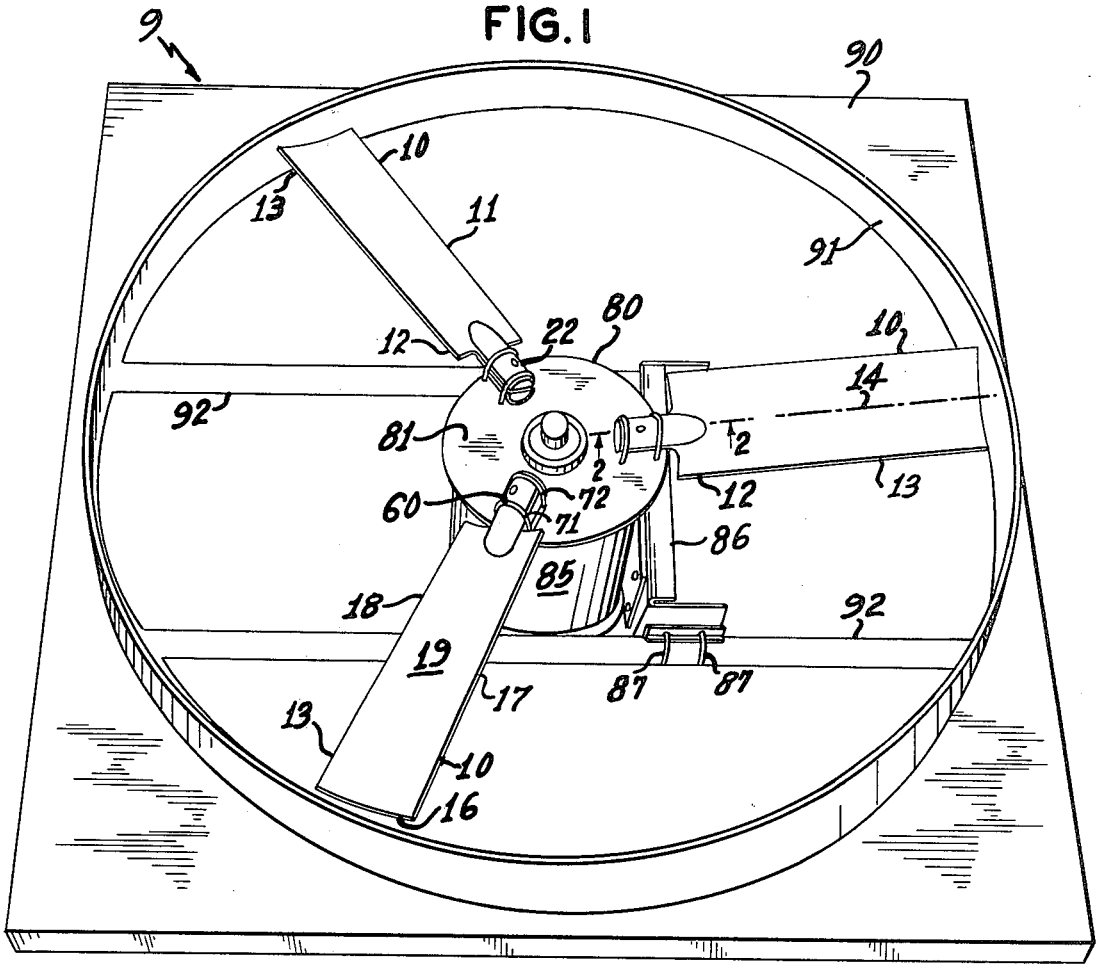
FIG. 1 is a perspective view of the fan apparatus in accord with this invention.

Referring now more particularly to the drawing, the fan apparatus is generally designated by numeral 9 in FIG. 1 and includes a plurality of blade assemblies 10 radially positioned at adjustable pitch positions about a rotor 80 which is pivoted to a motor 85 that is mounted on a housing 90.

Elongated blade 11 is preferably formed of an extruded material, such as aluminum, and is provided with an inner end portion 12 and an outer end portion 13 with a longitudinal axis 14 extending therebetween as shown in FIG. 1. Being formed by an extrusion process, the blade 11 has a substantially constant cross-section extending between the inner and outer blade end portions.

Figure 7:
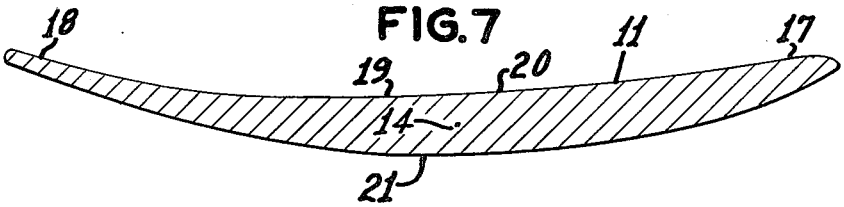
FIG. 7 is an enlarged cross-sectional view taken along line 7—7 of FIG. 4.

First end portion 12 includes an end wall 15 having a shank 25 integrally formed or extruded therewith and extending from the end wall 15 so that a longitudinal axis 33 of the shank 25 is substantially parallel with the longitudinal axis 14 of the blade 11. Preferably, to form a rotationally stable fan blade assembly, the longitudinal axis 14 of blade 11 extends through the center of gravity of the blade and similarly, the longitudinal axis 14 of the shank 25 extends through the center of gravity of the shank and it is further envisioned that the longitudinal axes 14 and 33 will be substantially coincident. Blade 11 also includes a flat end wall 16 and first and second longitudinal side portions 17 and 18, with the second side portion 18 being relatively thinner and wider than the first side portion 17. Disposed between the first and second side portions is an intermediate portion 19, generally shown in FIG. 1, through which the longitudinal axis 14 of the blade 11 extends. Additionally, in FIG. 7, the blade 11, which generally has an airfoil cross-section, includes a generally inwardly curved or concave top surface 20 and a generally outwardly curved or concave bottom surface 21. The curved configuration of the surfaces of the blade 11 tends to increase the bending moment resistance of the blade and shank against lateral forces applied to the respective top and bottom surfaces 20 and 21.

Shank 25, which is integrally formed with the elongated extruded blade 11, has a lateral dimension less than the lateral dimension of the inner end portion 12 of the blade 11 and the shank 25 may be formed by cutting, machining or otherwise removing material from the inner end portion of the elongated blade until a shank of suitable dimensions is produced. To avoid stress concentrations and discontinuities, such as would occur at notches, holes or sharp corners, the shank side edges 28 include curved portions where the shank 25 merges with the blade inner end portion 12.

Figure 2:
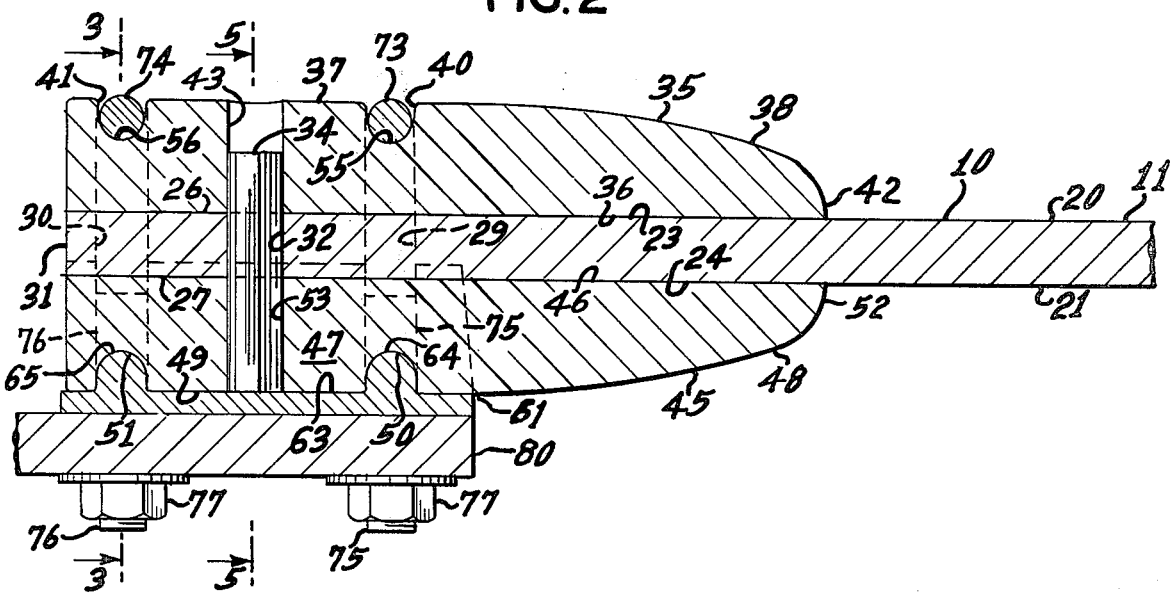
FIG. 2 is an enlarged partial cross-sectional view taken along line 2—2 of FIG. 1.
Figure 4:
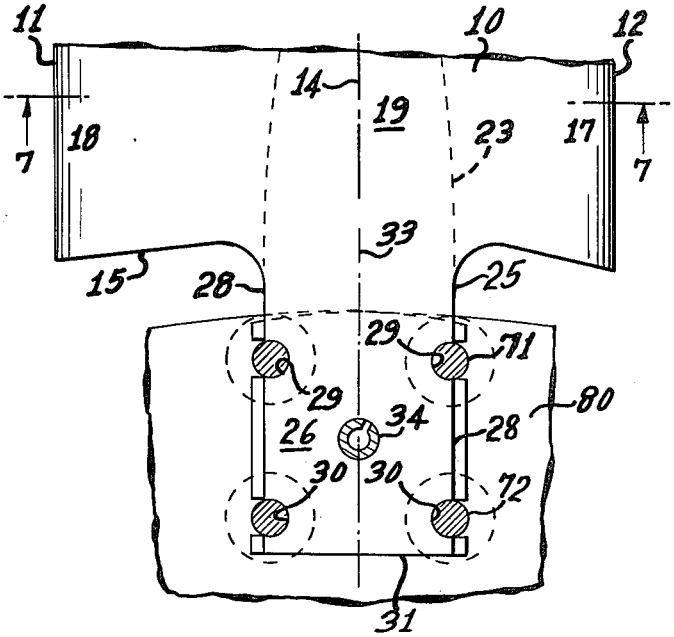
FIG. 4 is a reduced fragmentary cross-sectional view taken along line 4—4 of FIG. 3.

As shown in FIGS. 2 and 4, the shank 25 is elongated, having a rectangular top surface 26 and a rectangular bottom surface 27 forming respective continuations of the blade top and bottom surfaces 20 and 21. Thus, when initially formed, the top and bottom surfaces of the shank 25 will have generally the same curvature as the respective top and bottom surfaces of the blade. However, further machining operations may be employed to alter the curvature of either the top surface 26 or bottom surface 27 of the shank 25 without adversely affecting the structural strength of the shank 25 or the curvature of the blade 11. Further, the shank top and bottom surfaces may be flattened to accomodate flat abutting surfaces of the mounting members.

Figure 3:
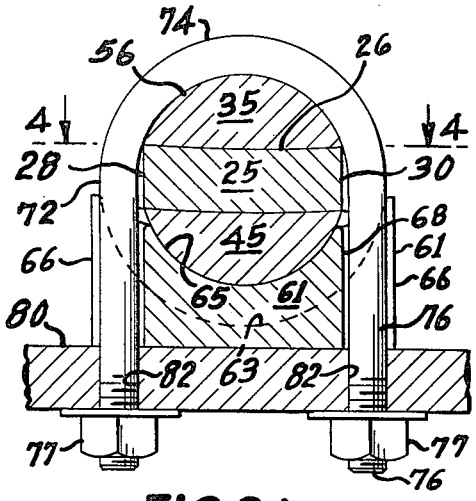
FIG. 3 is a cross-sectional view taken along line 3—3 of FIG. 2.
Figure 3A:
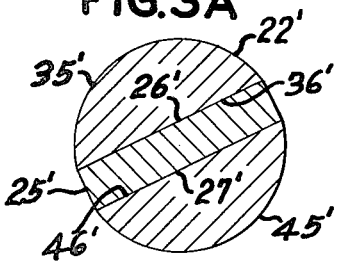
FIG. 3A is a view similar to FIG. 3 of a modified stem portion of a blade assembly.

FIG. 3A is an exemplary reduced cross-sectional view of a stem portion 22' of a blade assembly wherein the shank 25' and adjoining longitudinal portions of the blade have generally parallel, flat top and bottom surfaces. Mounting member 35' includes an abutting surface 36' which respectively overlies the top surface 26' of the shank 25' and an adjoining region of the generally flat top surface of the adjoining longitudinal portion of the blade. Similarly, mounting member 45' includes an abutting surface 46' which respectively overlies the bottom surface 27' of the shank 25' and an adjoining region of the generally flat bottom surface of the adjoining longitudinal portion of the blade. With the blade being extruded and the shank surfaces and adjoining regions being flat and parallel, the entire surface length of the blade corresponding to the width of the shank will also be flat and parallel to reduce any machining or the like, and thus identical cast mounting members may be employed.

During or subsequent to the initial formation of the shank, one or more sets of spaced grooves can be formed in the side edges 28 of the shank. As depicted in FIG. 4, a first and second pair of spaced grooves 29 and 30 respectively extend from the bottom surface 27 to the top surface 26 of the shank, wherein such grooves are designed to receive coupling means 60 in the form of projecting ribs which serve to secure the blade assemblies 10 to the rotor 80. Accordingly, the dimensions of the shank and the depth and particular orientation of the grooves can be selected to maximize different loading patterns (such as shear stresses, bending moments, centrifugal tensile forces and/or fluctuating loads) which can be applied to the blade assembly 10. For example, a longitudinal tensile load applied to the region of the shank adjacent the shank groove 30 may result in a longitudinal shear failure of the material between the groove 30 and shank end wall 31 and if such is anticipated, the shank may be lengthened and/or the grooves 30 may be formed further away from the end wall 31. Further, a substantially central aligning passageway 32 is provided in the shank and if it is anticipated that this stress discontinuity (passage 32) would have an adverse affect upon the strength of the connecting flange 25, it may be re-positioned and/or the flange redesigned.

Figure 5:
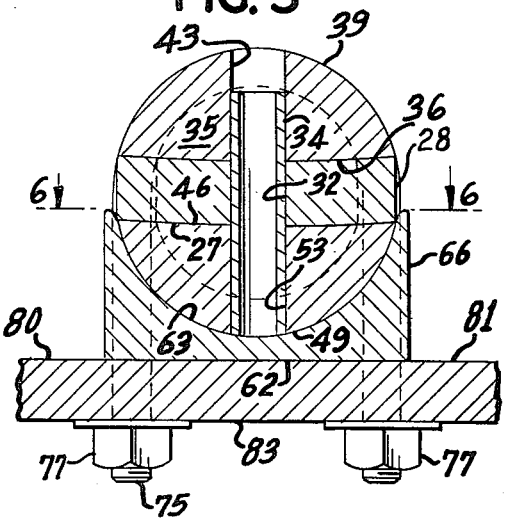
FIG. 5 is a cross-sectional view taken along line 5—5 of FIG. 2.
Figure 6:
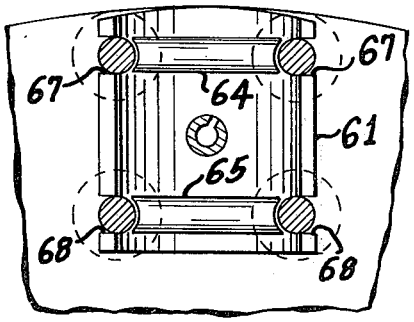
FIG. 6 is a reduced fragmentary cross-sectional view taken along line 6—6 of FIG. 5.

Elongated first mounting member 35 has an abutting surface 36 generally conforming to and coextensive with the top surface 26 of shank 25 and an adjoining region 23, shown in broken lines in FIG. 4, of the top surface 20 of the inner end portion 12 of blade 11. The abutting surface 36, as shown in FIG. 5, is convex or outwardly curved to conform with the concave or inwardly curved top surfaces 20 and 26 of the blade 11 and shank 25 respectively. Preferably of a rigid material, such as cast aluminum, the mounting member 35 has a first end portion 37 adapted to overlie the top surface 26 of shank 25 and a second end portion 38 adapted to generally overlie the adjoining region 23 of top surface 20 of blade 11. Having a semi-cylindrical configuration, the first end portion 37 has an outer generally cylindrical surface 39 provided with a pair of spaced arcuate grooves 40 and 41 adapted to receive curved rib portions of coupling means 60. Second end portion 38 has a semi-conical configuration which symmetrically tapers in thickness and width towards an outer edge 42 of the mounting member 35. As a result, the tapered second end portion 38 tends to be relatively more flexible than the more rigid first end portion 37. Accordingly, when the mounting members 35 and 45 are properly clamped to the blade 11 a connection is formed which provides an efficient, controlled distribution of stress from the blade 11 to the coupling means 60.

The elongated second mounting member 45 is of similar construction as mounting member 35 and includes a generally concave or inwardly curved abutting surface 46 generally conforming and coextensive with the outwardly curved bottom surface 27 of shank 25 and an adjoining region 24 of the bottom surface 21 of blade 11. Preferably formed of a rigid material, such as cast aluminum, the mounting member includes a semi-cylindrical first end portion 47 adapted to generally overlie the bottom surface 27 of the shank and a second end portion 48, which is semi-conical and converges toward an outer edge 52 of the mounting member 45. The first end portion 47 includes a generally cylindrical surface 49 with a pair of generally parallel spaced grooves 50 and 51 adapted to receive curved rib portions of the coupling means 60. Aligning passages 43 and 53 are respectively provided in the first and second mounting members to enable an assembly means, in the form of deformable element 34, to extend through the passage 43 and 53 and a central aligning passage 32 in the shank 25. When connected together by the assembly means, the respective first and second mounting members define a stem portion, generally represented by element 22, of the blade assembly 10 with the respective grooves 29, 40 and 50 forming a first circumferential groove, generally represented by element 55, and respective grooves 30, 41 and 51 forming a second circumferential groove 56. Deformable element 34, which is shown as a rolled plate, allows relative movement of the first and second mounting members and the shank so that rib means of the coupling means 60 can be properly disposed in the circumferential grooves 55 and 56.

The rotor assembly includes coupling means 60 attached to the rotor 80 for adjustably clamping the shank 25 and the adjoining regions 23 and 24 of the respective top and bottom surfaces of the blade 11 between the abutting surfaces 36 and 46 of the first and second mounting members. Coupling means 60 includes a mounting saddle 61 having a flat side 62 mounted on the flat surface 81 of the rotor and a curved opposite side 63 provided with curved ribs 64 and 65, which constitute portions of the rib means received by the circumferential grooves 55 and 56. The side edges 66 of the mounting saddle 61 have first and second pairs of spaced parallel vertical grooves 67 and 68 generally aligned with respective first and second curved ribs 64 and 65. The coupling means 60 further includes clamp means in the form of a pair of U-shaped clamps 71 and 72 having respective intermediate curved portions 73 and 74, constituting the other portion of the rib means disposed in substantially the remaining portions of the circumferential grooves 55 and 56. End portions 75 and 76 of the clamps 71 and 72, respectively, are connected to the rotor by extending the respective end portions through passages 82, which extend through the rotor 80 from the flat face 81 to an opposite side 83, and attaching the respective U-bolt end portions to the opposite side 83 with connecting means in the form of threaded fasteners 77.

When one or both of the U-clamps 71 and 72 are tightened, the respective curved portions 73 and 74 of the U-clamps and the respective curved rib portions 64 and 65 of the mounting saddle 61 clampingly engage the appropriate circumferential grooves 55 and 56 such that the adjacent portions of the shank 25 experience a substantially uniform transverse clamping force. As a result, a relationship can be established between the torque applied to the fasteners 77, which engage the bolt end portions 75 and/or 76, and the resulting clamping force applied to the shank 25. Additionally, while the first end portions 37 and 47 of the mounting members 35 and 45 are relatively rigid, the respective second end portions 38 and 48 are relatively less rigid towards the respective outer edges 42 and 52. Accordingly, if the mounting members are transversely deflected under applied loads, a greater degree of deflection will occur adjacent the outer edges 42 and 52 than adjacent the first end portions 37 and 47. Additionally, in a connection formed with the mounting members 35 and 45 and respective regions of the blade 11 and shank 25, the relative flexibility and stiffness of the first and second end portions of the mounting members contribute to an efficient distribution of applied stresses from the blade 11 to the shank 25 and the respective mounting members.

The rotor 80 includes a flat side 81 and an opposite side 83. Additionally, the rotor 80 is provided with a plurality of sets of mounting holes or passages 82 radially disposed about the perimeter of the rotor to permit the blade assemblies 10 to be attached thereto. Rotor 80, in turn, is rotatably mounted to a motor 85 which is joined to an adjustable mounting bracket 86. To center the rotor 80 and blade assemblies 10 within the housing 90 so that the blade outer end portions 13 do not strike or otherwise contact the walls 91 of the housing 90, bolts or fasteners 87 on mounting bracket 86 are loosened and the mounting bracket 86 and motor 85 are moved on spaced housing rails 92 to a suitable position.

Where desirable to conserve material and to effect improved contact between various portions of the elements, recesses or indentations may be formed in the element, preferably without extensive machining operations. For example, the flat side of the mounting saddle 61 can be formed with recesses extending between and/or on either side or both sides of the curved ribs. Similarly, the respective abutting surfaces 36 and 46 of the mounting members 35 and 45 may be formed with recesses extending between and/or on either side of the respective spaced grooves 40, 41 and 50, 51.

Additionally, where desirable to have a relatively fixed pitch blade assembly, the stem portion of the blade assembly may be formed with one or more non-circular groove portions and/or non-circular surface portions of the stem such that rotation of the stem portion in a corresponding mounting saddle will be precluded.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A fan apparatus comprising a rotor assembly including a rotor having an axis of rotation and a flat surface, a plurality of fan blade assemblies adjustably coupled to said rotor in selectable pitch positions, each of said fan blade assemblies including an elongated blade provided with top and bottom surfaces and inner and outer end portions and a longitudinal axis; an elongated shank having a lateral dimension less than the lateral dimension of said blade and integrally formed with said blade inner end portion and having top and bottom surfaces forming respective continuations of said blade top and bottom surfaces and having a longitudinal axis substantially parallel with said longitudinal axis of said blade; a first mounting member having an abutting surface generally conforming to and generally coextensive with said shank top surface and an adjoining region of said top surface of said blade inner end portion; a second mounting member having an abutting surface generally coextensive with said shank bottom surface and an adjoining region of said bottom surface of said blade inner end portion; said first and second mounting members and said shank defining a stem portion of said blade assembly, said stem portion including a circumferential groove; said rotor assembly including coupling means attached to said rotor for adjustably clamping in selectable pitch positions said stem portions between said abutting surfaces of said first and second mounting members, said coupling means including rib means adapted to be received in said circumferential groove to securely fix the relative position of said first and second mounting members and said shank, and coupling means further including a plurality of mounting saddles each having a flat side located generally beneath said shank and mounted on said rotor flat surface and an opposite side provided with a curved rib constituting a portion of said rib means, said curved rib being received in a portion of said circumferential groove, said coupling means further including a plurality of U-shaped clamps each having an intermediate curved portion constituting another portion of said rib means and disposed in substantially the remaining portion of said circumferential groove, and free end portions of each said clamp being connected to said rotor; said first and second mounting members and blade being free from any discontinuities and connections passing through said blade adjoining regions to inhibit fatigue failure of said blade.

2. The fan apparatus according to claim 1, wherein said stem portion is substantially circular in cross-section.

3. The fan apparatus according to claim 1, wherein said shank top and bottom surfaces are respectively curved inwardly and outwardly about said shank longitudinal axis, said first mounting member abutting surface being outwardly curved to conform with said shank top surface, and said second mounting member abutting surface being inwardly curved to conform with said shank bottom surface.

4. The fan apparatus according to claim 1, further comprising passages extending through said first and second mounting members and a central portion of said shank, said passages being aligned and an assembly means extending therethrough.

5. The fan apparatus according to claim 1, wherein said blade and shank are integral and formed of extruded metal.

6. The fan apparatus according to claim 5, wherein said first and second mounting members are of rigid cast metal.

7. The fan apparatus according to claim 1, wherein said rotor includes spaced passages extending through said rotor from said flat face to an opposite side thereof, said free end portions extending through said spaced passages and attached to said opposite side with connecting means.

8. The fan apparatus according to claim 1, wherein said blade and shank are formed of extruded aluminum material and said first and second mounting members are formed of a cast aluminum material.

9. A fan blade apparatus comprising a rotor assembly including a planar substantially solid rotor having an axis of rotation and flat surface portions adapted to receive a plurality of fan blade assemblies each having an elongated blade provided with top and bottom surfaces and inner and outer end portions and a longitudinal axis, an elongated shank having a lateral dimension less than the lateral dimension of said blade and integrally formed with said blade inner end portion and having top and bottom surfaces forming respective continuations of said blade top and bottom surfaces and having a longitudinal axis substantially parallel with said longitudinal axis of said blade, an elongated first mounting member having an abutting surface generally conforming to and generally coextensive with said shank top surface and an adjoining region of said top surface of said blade inner end portion, an elongated second mounting member having an abutting surface generally conforming to and generally coextensive with said shank bottom surface and an adjoining region of said bottom surface of said blade inner end portion, said shank and first and second mounting members constituting a stem, said stem having a circumferential locking indentation formed therearound, and means for coupling said first and second mounting members to said blade and to said rotor, said coupling means including a plurality of mounting saddles of a lateral dimension substantially equal to said stem lateral dimension and each having a flat side mounted on one of said rotor flat surface portions, each said mounting saddle having a locking circumferential rib located on its opposite side and being engageable with respective said circumferential locking indentation of said stem, said coupling means further including clamp means having circumferential portions engageable with respective said circumferential locking indentation of said stem whereby said stem locking indentation is substantially filled, said mounting members and blade being free of any discontinuities and connections passing through said blade adjoining regions to inhibit fatigue failure of said blade.

10. The assembly according to claim 9, wherein said first and second mounting members have generally semi-cylindrical first end portions respectively generally contacting said shank top and bottom surfaces and generally semi-conical second end portions converging from said first end portion and respectively in juxtaposition with said top and bottom adjoining regions of said inner end portion of said blade.

11. The assembly according to claim 10, wherein said first end portions of said first and second mounting members and said shank define a fan blade stem portion having a substantially circular cross-section.

12. The assembly according to claim 10, wherein said shank extends generally centrally from an end wall of said blade inner end portion.

13. The assembly according to claim 9, wherein said blade has a substantially uniform cross-section extending between said blade inner and outer end portions.

14. The assembly according to claim 13, wherein said first and second mounting members have generally semi-cylindrical first end portions respectively generally contacting said shank top and bottom surfaces and generally semi-conical second end portions converging from said first end portion and respectively in juxtaposition with said top and bottom adjoining regions of said inner end portion of said blade.

15. The assembly according to claim 14, wherein said shank top and bottom surfaces are respectively curved inwardly and outwardly about said shank longitudinal axis, said first mounting member abutting surface being outwardly curved to conform with said shank top surface, and said second mounting member abutting surface being inwardly curved to conform with said shank bottom surface.

16. The assembly according to claim 9 wherein said blade longitudinal axis generally extends through the center of gravity of said blade, said shank longitudinal axis generally extends through the center of gravity of said shank and said blade longitudinal axis and said shank longitudinal axis are generally coincident.

17. The assembly according to claim 9, further comprising aligned passages extending through said first and second mounting members and a central portion of said shank, said means for coupling including an assembly means extending through said aligned passages.

* * * * *